United States Patent [19]

Hughes

[11] Patent Number: 4,831,852

[45] **Date of Patent: * May 23, 1989**

[54] KEY OPERATED LOCK

[76] Inventor: Donald R. Hughes, 2600 Brower, Simi Valley, Calif. 93065

[ * ] Notice: The portion of the term of this patent subsequent to Aug. 4, 2004 has been disclaimed.

[21] Appl. No.: 202,580

[22] Filed: Jun. 6, 1988

[51] Int. Cl.[4] ..... E05B 27/08

[52] U.S. Cl. ..... 70/491; 70/419; 70/378

[58] Field of Search ..... 70/491, 419, 421, 378, 70/363

[56] References Cited

U.S. PATENT DOCUMENTS

| | | | |
|---|---|---|---|
| 51,152 | 11/1865 | Dietz | 70/491 |
| 2,629,249 | 2/1953 | Mendelsohn | 70/419 |
| 3,681,955 | 8/1972 | Sturgeon | 70/491 |
| 4,041,739 | 8/1977 | Mercurio | 70/419 |
| 4,546,629 | 10/1985 | Hwang | 70/491 |
| 4,638,739 | 8/1987 | Hughes | 70/419 |
| 4,716,749 | 1/1988 | Johnson | 70/378 |

*Primary Examiner*—Robert L. Wolfe

*Attorney, Agent, or Firm*—Jack C. Munro

[57] ABSTRACT

An axial type, tubular key operated, cylinder lock which utilizes a plurality of spring-biased pin arrangements which are to be movable when connected with the proper key to a shear-line position achieving operation of said lock. A pin arrangement is movable longitudinally to the shear-line position. Any attempt to move a pin arrangement other than with a properly coded key will result in the pin arrangement being laterally deflected to a displaced-fixed position preventing operation of the lock.

8 Claims, 2 Drawing Sheets

KEY OPERATED LOCK

BACKGROUND OF THE INVENTION

The field of this invention relates to locks and more particularly to the axial cylinder lock commonly known as a tubular lock.

The use of tubular locks has long been known. Reference is to be had to the aforementioned U.S. Pat. No. 4,683,739 where there is shown and described one such tubular lock and specifically a tubular lock which has been specifically constructed to be "highly pick resistant". The lock shown and described within the aforementioned patent is a substantial improvement over prior art tubular locks in that the lock of this patent is extremely difficult to be "picked". However, there is always room for improvement in the tubular lock field with this improvement being to construct a highly pick resistant lock which can be manufactured as inexpensively as possible.

SUMMARY OF THE INVENTION

The primary objective of the present invention is to construct a highly pick resistant lock which can be manufactured at minimal cost and yet maintains the quality of previous types of highly pick resistant locks such as described within U.S. Pat. No. 4,683,739.

Another objective of the present invention is to construct a tubular lock which requires only minor modification of conventional tubular lock mechanisms thereby minimizing manufacturing expense.

Another objective of the present invention is to construct a lock which provides for the highest degree of security to the user by the user knowing that the lock is highly pick resistant. Such a lock would be most desirable on gaming machines, vending machines, laundermats, burglar alarm switches, pad locks, parking meters, government and military applications, computers and other similar types of equipment.

The lock of the present invention utilizes a housing which is adapted to be fixedly mounted within a door or other similar type of exterior structure. Mounted for pivotable or rotational movement within the housing is a shaft and this shaft extends from the housing and is adapted to be connected to a lock lever mechanism which is mounted in conjunction with the door. Movement of the shaft from a locking position to an unlocking position results in similar movement of a locking lever mechanism which has been mounted in conjunction with the door. Movement of the shaft from the locking position to an unlocking position results in similar movement of a locking lever mechanism from a locked position to an unlocked position. In between the shaft and the housing of the lock and within the interior of the housing are located a plurality of pin arrangements. Each pin arrangement comprises a driver pin and coding pin with a spring located in an in-line manner in conjunction with each driver pin. It is the function of each spring to exert a constant bias tending to locate the driver pin (and its respective coding pin) in an extended position. Each pin arrangement is to be movable in a first direction which is parallel to the longitudinal center axis of the housing. Movement of these pin arrangements in this first direction is achieved by connection with a key. Each coding pin is mounted within an opening in a cage. Each driver pin is mounted within an opening in a barrel. The cage includes a single annular gap which results in the forming of an annular disc.

The barrel also includes a single annular gap which results in the forming of a second disc. Each coding pin has formed within its annular exterior surface a single annular recess. In a similar manner, each driver pin has formed within its annular exterior surface a single annular recess. Normal connection of the pin arrangement with the proper key results in the pin arrangement to be moved only in the first direction. Any attempt to pick the lock and the applying of a torque to these pin arrangements will result in either the driver pin or the coding pin deflecting laterally and binding up. This lateral deflection fixes the position of the driver pin or the coding pin and will prevent movement along the first direction. Any attempt to further "pick" the lock will be to no avail as it will not be possible to move the pin arrangements so that they will be located at the shear-line position.

DETAILED DESCRIPTION OF THE SHOWN EMBODIMENT

Figure 1:
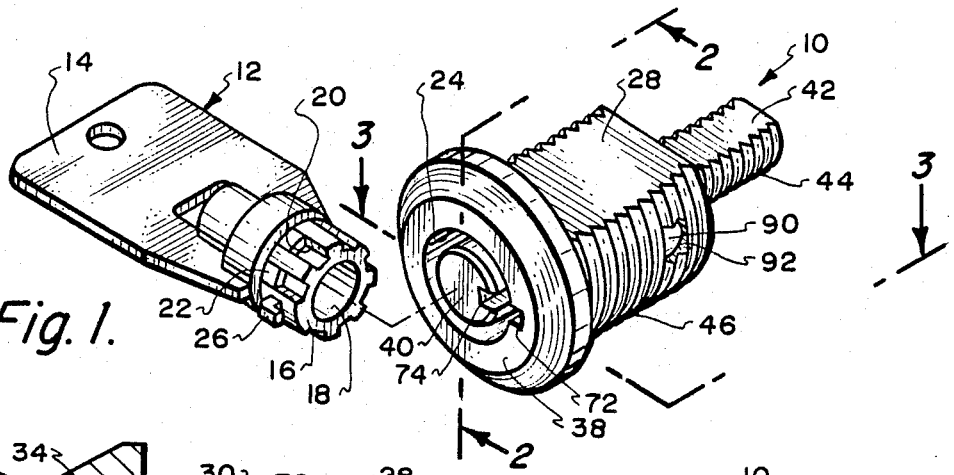
FIG. 1 is an isometric view of the lock of the present invention depicting association with a type of key being used to operate the lock.

Referring particularly to the drawings, there is shown the lock 10 of this invention which is to be operated by a key 12. Key 12 includes a handle 14 and a tubular barrel 16. The barrel 16 has a hollow chamber 18. Formed on the exterior surface of the barrel 16 are a plurality of spaced apart grooves 20. Associated with each groove 20 is a strip 22. The strips 22 are all of a different length so that a portion of each groove that extends forwardly of the strip is also of a different length. When the barrel 16 is inserted within the opening 24 of the lock 10, there will be a pin (to be described) which will connect with each groove 20. The head of this pin will come into contact with the forward edge of the strip 22 within each of the grooves 20. The distance of the outer edge of the barrel 16 to the edge of each strip 22 determines the amount of inward movement of each of the pins. If the correct key 12 is connected with lock 10, each of the pins will be moved to locate the lock 10 at a "shear-line" which will then permit the lock 10 to be moved between the locked position and an unlocked position. It is also to be noted that on the exterior surface of the barrel 16 there is located a protuberance 26.

The lock 10 is formed of a housing 28 which has an internal chamber 30. Internal chamber 30 is basically cylindrical and is open at the back end and is substantially closed at the front end by outer annular ledge 32. Ledge 32 terminates at an annular wall 34. This annular wall 34 is concentric to internal chamber 30. Annular ledge 36, which is parallel to annular ledge 32, separates internal chamber 30 from the annular wall 34.

The outer frontal surface of the housing 28 is formed into a planar face 38. The opening 24 extends between the face 38 and the annular ledge 32 thereby connecting the opening 24 to the internal chamber 30. Mounted within the opening 24 is a nosepiece 40. The outer planar surface of the nosepiece 40 coincides with the planar face 38 of the housing 28. The nosepiece 40 is integral with and is formed part of a shaft 42 which protrudes exteriorly from the back end of the housing 28. The shaft 42 includes a series of exterior threads 44 which is to facilitate connection with a lock mechanism (not shown). This lock mechanism is what is utilized to fixedly secure the door (not shown) or other movable part of an exterior structure (not shown).

It is to be noted that the housing 28 includes a series of screw threads 46. These screw threads 46 are also to facilitate securement to within the door or the appropriate movable part of the exterior structure. It is to be understood that the flange 48 is to abut against the exterior surface of the door. Located between the nosepiece 40 and the shaft 42 is an annular shoulder 50. Mounted on the shaft 42 within the internal chamber 30 and abutting against the shoulder 50 is a cage 52. This cage 52 has formed therein seven in number of spaced apart holes 54. Within each hole 54 is located a coding pin 56. This coding pin 56 is substantially cylindrical with the exception of annular recess 58. It is to be noticed that the size of the hole 54 is greater than the diameter of the coding pin 56. Actually, the size of hole 54 will only be a few thousandths of an inch greater than the diameter of the coding pin 56. However, in the drawings, this size differential is exaggerated for clarity of illustration. It is also to be noticed that the longitudinal center axis of the coding pins 56 is normally parallel to the longitudinal center axis of the respective hole 54. The longitudinal center axis of the hole 54 is located parallel to the longitudinal center axis 60 of the shaft 42. The inner end of each of the coding pins 56 terminates at a head 62 which has a rounded exterior configuration.

This cage 52 has a radially disposed hole 64. Within this hole 64 is located a pin 66. This pin 66 is fixedly mounted within the shaft 42 thereby fixing in position the cage 52 to the shaft 42. Formed within the exterior surface of the cage 52 is an annular gap 68. This annular gap 68 results in the forming of a disc 70.

It is to be understood that the overall length of the coding pins 56 will normally vary for each hole 54 of a given lock mechanism. The shorter the pin 56, the longer its respective strip 22 of the key 12. When the key 12 is inserted within the opening 24 a strip 22 is to contact a coding pin 56. When the key 12 is inserted in conjunction with the lock 10, the protuberance 26 will be located within notch 72 of the housing 28. There is also located within the hollow chamber 18 a protuberance (not shown) which is to be located within the notch 74 of the nosepiece 40. This insures that only the proper strip 22 connects with the proper coding pin 56.

Abutting against the rounded surface of the head 62 of each coding pin 56 is the rounded head section 76 of a driver pin 78. This driver pin 78 also includes an annular recess 80. The aft end of each driver pin 78 is formed into a narrowed rod 82. The rod 82 functions as a retainer for the outer end of a coil spring 84. There is to be a coil spring 84 located within each hole 86 of a barrel 88. There is to be seven in number of holes 86 which is the same number of the holes 54. There is to be a hole 86 in axial alignment with a hole 54. The barrel 88 is fixedly mounted by a pin 90 which is located within hole 92 of the housing 28. In other words, the barrel 88 is fixedly mounted onto the housing 28.

It is to be noted that there is located a driver pin 78 within each hole 86. The size of the hole 86 is greater than the diameter of the driver pin 78. The reason for this will be explained further on in this specification.

It is also to be noticed that the driver pin 78 will normally vary in length. The length of the driver pin 78 and its respective coding pin 56 is selected so that when the proper key 12 is connected to the lock 10, the point of contact between the round heads 62 and 76 is located at the shear-line which is to be defined as the space 94 between the cage 52 and the barrel 88. When each of the pin arrangements, defined as an aligned pair of a driver pin 78 and a coding pin 76, are located at this shear-line 94, it is possible to rotate the shaft 42 relative to the housing 28 and thereby affect operation of the lock 10 by rotating shaft 42.

Now let it be assumed that someone wishes to "pick" the lock 10. In order to do so, that particular individual will have to insert something within the opening 24 and apply pressure against the coding pins 56. It is common that the one attempting to "pick" the lock 10 will either just locate the picking device against the pins 56 press against the pins sufficiently so that they will move them initially to an inwardly displaced position compressing totally each of the springs 84. Whichever initial starting position the "picker" starts with, the picker will then apply a small amount of rotational torque onto the shaft 42 which will apply a small amount of force to the pins 56 and 78. Once this torque has been applied, the picker will then apply either pressure pushing against the pin arrangement or attempt to retract that pin arrangement if the spring 84 is compressed. In the former situation, once the head 76 becomes aligned with annular gap 68 the head 76 deflects tilting driver pin 78, causing the disc 70 to come to rest within the annular recess 80. To the picker this gives the appearance of a slight click which is felt and heard to one with sensitive hearing. To the picker, this gives an indication that the "shear-line" has been reached. According to the "picker's" senses of sight, hearing and feel, the picker believes the shear-line has been reached. However, this is false and what actually has occurred is that the pin assembly is fixed and a position fixing between that driver pin 78 and the cage 52 has occurred. As the picker continues to move through each succeeding pin arrangement, the same occurs which results in the picker now believing that the shear-line 94 has been reached for each pin arrangement. Now when the picker attempts to rotate the shaft 42, such will not rotate and the lock has not been picked.

In the latter situation, as the picker attempts to apply a releasing force to each pin arrangement, longitudinal movement of each aligned pair of the pin arrangements will occur until the head 62 connects with annular gap 96 formed within the exterior surface of the barrel 88. The creation of this annular gap 96 has formed a disc 98. Once the annular recess 58 of coding pin 56 is aligned with disc 98 of the barrel 88 the head 62 will deflect with the disc 98 coming to rest within the recess 58 of the coding pin 56. Again, the same situation occurs to the picker and it gives the indication that the shear-line 94 has been reached and the same will occur for each pin arrangement. Again, rotation of the shaft 42 relative to the housing 28 is prevented.

In essence, if any rotational torque is applied to the shaft 42 prior to the pin arrangements reaching the shear-line 94, lateral deflection of either the driver pins 78 or the coding pins 56 will occur. It is to be understood that upon rotational torque being applied and then released that the coding pins 56 and the driver pins 78 will automatically move back to their axially aligned position and be centrally disposed within their respective holes 54 and 86.

It is to be understood that the structure of this invention could be incorporated in the conventional tumbler lock which uses a flat key.

Figure 2:
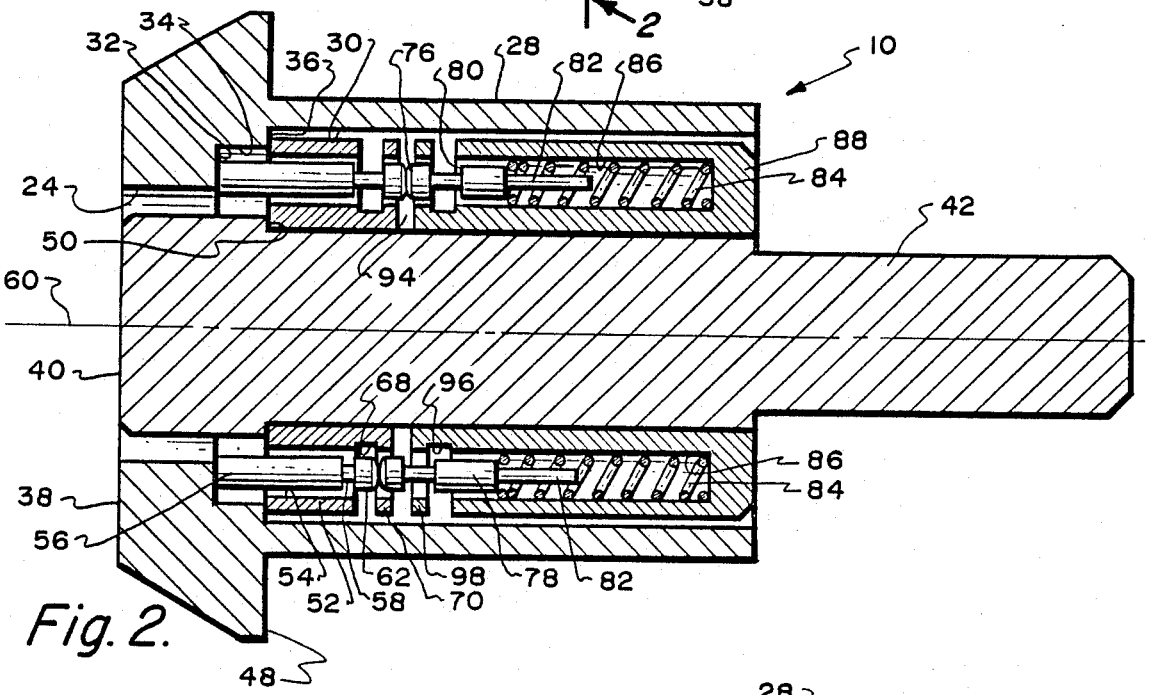
FIG. 2 is a longitudinal cross-sectional view of the lock of the present invention taken along line 2—2 of FIG. 1.
Figure 4:
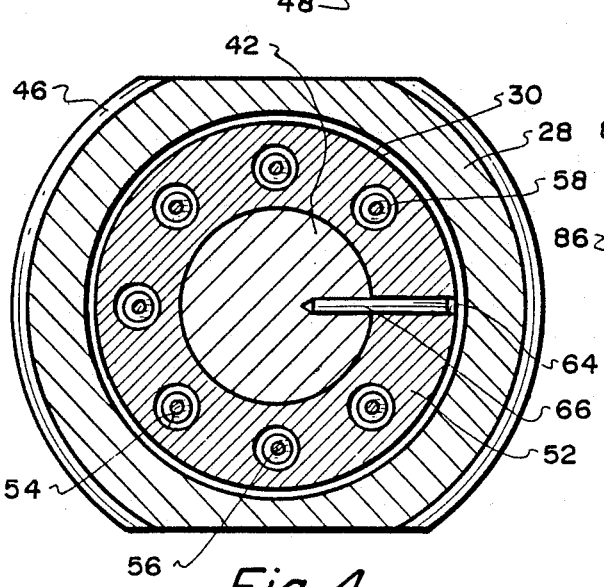
FIG. 4 is a transverse cross-sectional view through the lock of the present invention taken along line 4—4 of FIG. 3.
Figure 5:
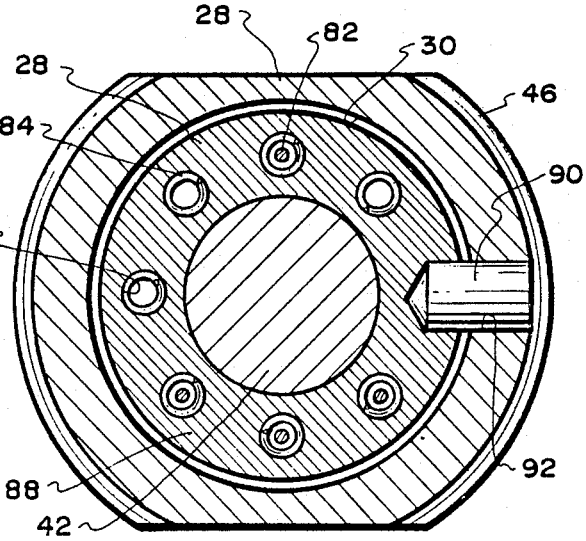
FIG. 5 is a further transverse cross-sectional view through the lock of the present invention taken along line 5—5 of FIG. 3.
Figure 3:
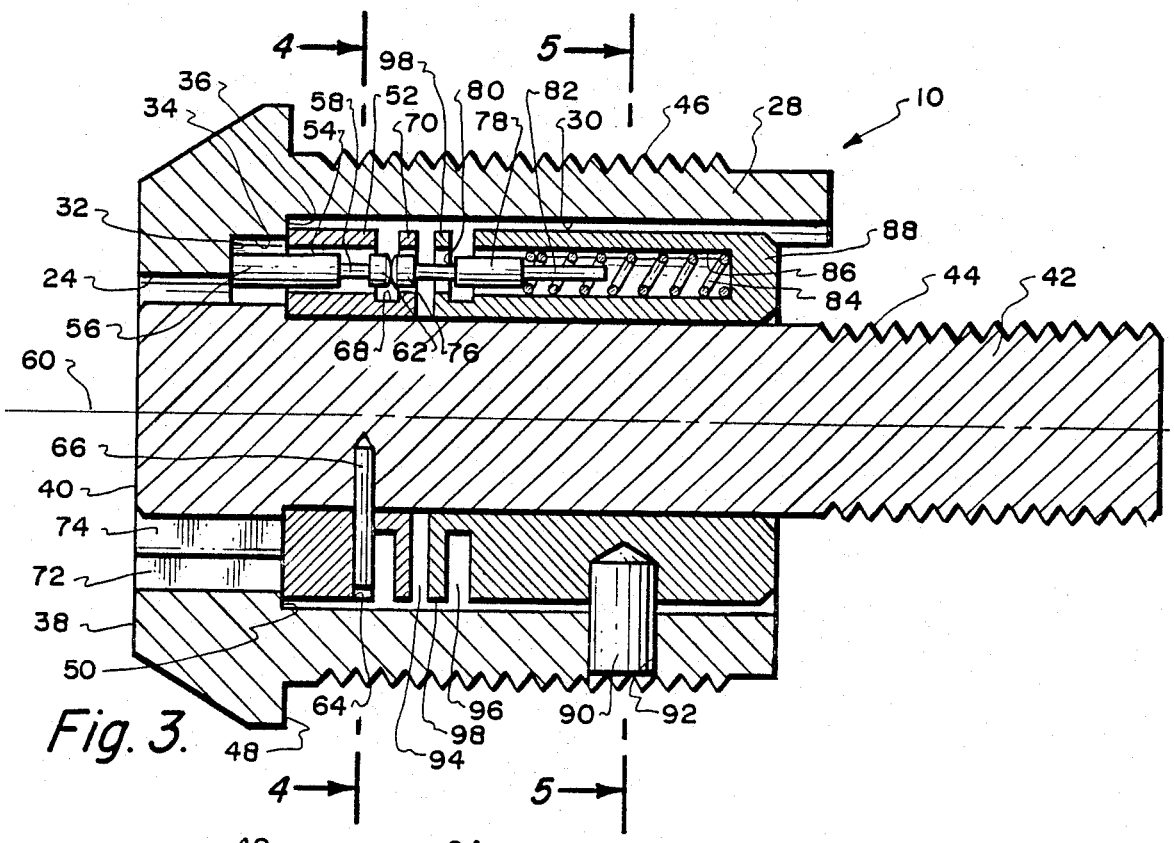
FIG. 3 is a longitudinal cross-sectional view similar to that of FIG. 2 but taken in a direction perpendicular to that of FIG. 2.
Figure 6:
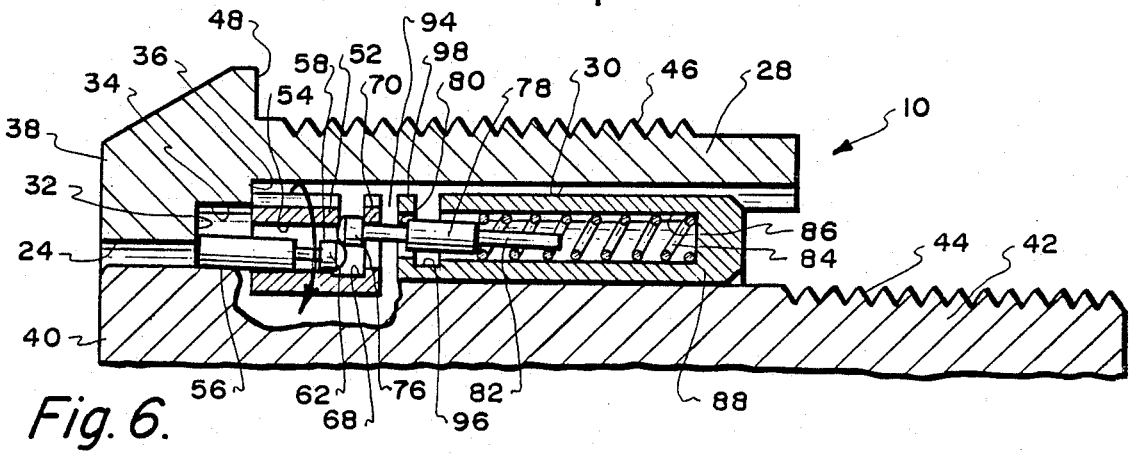
FIG. 6 is a view similar to FIG. 2 but only of a portion of the lock of the present invention showing a pin arrangement in one of the deflected positions such as would occur when a torque is applied such as when the lock is being picked.
Figure 7:
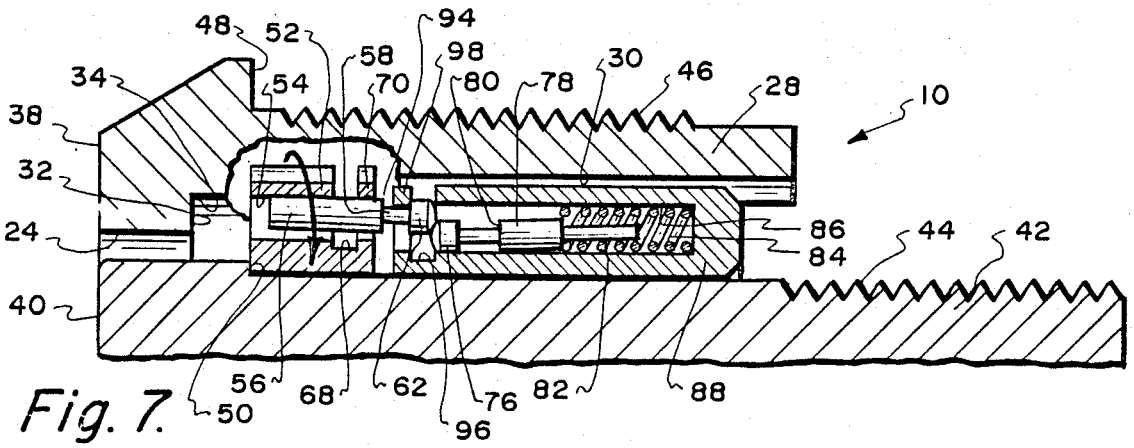
FIG. 7 is a view similar to FIG. 6 but showing the pin arrangement in another deflected position.

In referring to the drawings, it is to be noted that the shear-line 94 is shown to assume some amount of space. In actuality, the shear-line 94 will be quite small in width and may even have zero width when disc 98 abuts directly with disc 70. It is to be understood that the disc 70 and 98 are of the same width. A disc, either 70 or 98, must be capable of falling within the annular recess 58 or annular recess 80. This works satisfactorily when the shear-line 94 assumes some space as is clearly shown within FIGS. 1 through 7. With the discs 98 and 70 abutting, there is obtained in essence a single disc of double thickness.

However, a picker can locate the lock 10 in position where the shear-line 94 does not assume any space and discs 70 and 98 abut. In this particular position, the combined width of the discs 70 and 98 are greater than the length of the annular recess 58. Therefore, it may be desirable to have at least some of the pins constructed so that the length of the annular recess 58 and annular recess 80 is in excess of the combined width of discs 70 and 98. The reason for this is that with the discs 70 and 98 abutting, the lock 10 could be picked since the combined width of the discs 70 and 98 is too great to fall within the annular recesses 58 and 80. To avoid this happening, some of the pins have the greater length of annular recess 80. However, it is not feasible to construct all of the pins 56 and 78 to have the greater length annular recess 80 because the overall strength of the lock 10 could be diminished. Therefore, with just a few of the pins 56 and 78 having the greater length recess 80, such is satisfactory to prevent picking of the lock 10.

What is claimed is:

1. A key operated lock comprising:

a housing;

a shaft connected to said housing and extending exteriorly therefrom, said shaft having a longitudinal center axis, said shaft being movable between a locking position and an unlocking position, said shaft being adapted to connect with a separate locking lever mechanism and movement of said shaft causes movement of the separate locking lever mechanism between an unlocked position and a locked position;

means for fixing said shaft to said housing when said shaft is in said locking position, said means comprising a pin assembly, said pin assembly comprising a plurality of pin arrangements, each said pin arrangement being movable within a range of movement relative to said housing in a direction parallel to said longitudinal center axis, with said pin assembly located in a particular position said shaft is located in said unlocking position;

each said pin arrangement being capable of being deflected laterally in a direction substantially transverse to said longitudinal center axis, whereby upon said pin assembly being moved by connection with the proper key the said pin assembly moves in a direction only along said longitudinal center axis, whereby any attempt to pick said lock will cause at least one said pin arrangement to be deflected laterally preventing the ascertaining of said particular position and movement of said shaft relative to said housing;

each said pin arrangement comprising an in-line set of a driver pin and a coding pin and a spring, each said driver pin is mounted within a barrel, said barrel being fixed to said housing, each said driver pin to be continuously spring biased by its respective said spring in an outward direction, each said driver pin being movable parallel to said longitudinal center axis, first deflection means included between said driver pin and said barrel, said first deflection means permitting tilting lateral deflection of each said driver pin relative to said longitudinal center axis;

said first deflection means comprising a first annular recess formed within each said driver pin and a first annular gap formed within said barrel, except for said first annular recess the diameter of each said driver pin being constant, said first annular gap producing a first disc, said tilting lateral deflection occurring when said first disc slips into said first annular recess of any one of said driver pins; and said coding pins being mounted within a cage, second deflection means included between each said coding pin and said cage, said second deflection means comprising a second annular recess formed within each said coding pin and a second annular gap formed within said cage, except for said second annular recess the diameter of each said coding pin being constant, said second annular gap producing a second disc, said tilting lateral deflection occurring when said second disc slips into said second annular recess, said tilting lateral deflection also occurring when said first disc slips into said second annular recess and when said second disc slips into said first annular recess.

2. The lock as defined in claim 1 wherein: said annular recesses varying in length.

3. The lock as defined in claim 2 wherein:

the length of said first annular recess being greater than the combined width of said first disc and said second disc.

4. The lock as defined in claim 2 wherein:

the length of said second annular recess being greater than the combined width of said first disc and said second disc.

5. A key operated lock which uses a spring biased pin assembly which is to be moved in a first direction when connected with the proper key to a shear-line position achieving operation of said lock, said pin assembly being movable in a second direction, said second direction being substantially transverse to said first direction;

said pin assembly comprising a plurality of separate pin arrangements, each said pin arrangement comprising an in-line pair of a driver pin and a coding pin, each said driver pin being spring biased in its outward direction, each said coding pin to be contactable by said key, movement of a said coding pin in said first direction is to achieve movement of its respective said driver pin, each said driver pin being mounted within a barrel, said barrel including a first annular gap thereby forming a first disc, each said driver pin including a first annular recess, movement of said driver pins in said second direction results in said first disc being located within a said first annular recess, except for said first annular recess the diameter of each said driver pin being constant; and each said coding pin being mounted within a cage, said cage including a second annular gap thereby forming a second disc, each said coding pin including a second annular recess, except for said second annular recess the diameter of each said coding pin being constant, movement of said coding pins in said second direction results in said second disc being located within said second annular recess, said second direction being also when said first disc is located within said second annular recess and when said second disc is located within said first annular recess.

6. The lock as defined in claim 5 wherein:

said annular recesses varying in length.

7. The lock as defined in claim 6 wherein:

the length of said first annular recess being greater than the combined width of said first disc and said second disc.

8. The lock as defined in claim 6 wherein:

the length of said second annular recess being greater than the combined width of said first disc and said second disc.

* * * * *